US005366126A

United States Patent [19]

Dausien

[11] Patent Number: 5,366,126

[45] Date of Patent: Nov. 22, 1994

[54] KNAPSACK WITH REINFORCING ELEMENT

[76] Inventor: Ulrich Dausien, Starkenburgstr. 2, D-6082 Mörfelden-Walldorf, Germany

[21] Appl. No.: 969,141

[22] PCT Filed: Aug. 10, 1990

[86] PCT No.: PCT/EP90/01325

§ 371 Date: Mar. 10, 1993

§ 102(e) Date: Mar. 10, 1993

[87] PCT Pub. No.: WO92/02158

PCT Pub. Date: Feb. 20, 1992

[51] Int. Cl.[5] ..... A45F 3/08

[52] U.S. Cl. ..... 224/211; 224/210

[58] Field of Search ..... 224/210, 211, 212, 213, 224/209, 261, 262, 263

[56] References Cited

U.S. PATENT DOCUMENTS 4,074,839 2/1978 Wood et al. .
4,676,418 6/1987 Lowe .
4,934,573 6/1990 Jaeger ..... 224/210

FOREIGN PATENT DOCUMENTS 675687 5/1939 Austria ..... 224/212
0158154 10/1985 European Pat. Off. .
0273087 7/1988 European Pat. Off. .
8716869 3/1988 Germany .
3844675 6/1990 Germany .

*Primary Examiner*—Linda J. Sholl
*Attorney, Agent, or Firm*—Wenderoth, Lind & Ponack

[57] ABSTRACT

A knapsack has at least one reinforcing or stiffening element that is received in pockets provided on a back wall and that is concavely curved at least in part in the longitudinal and/or transverse directions. The stiffening element concavely deforms the back wall in the longitudinal and/or transverse directions. An elastic support band extends along a lower area of the stiffening element, and a supporting net is stretched therefrom to the upper area of the stiffening element, bridging a concavity in the stiffening element. This support band can extend between a lower marginal area of the stiffening element and the supporting net. In order to make it easier to mount and dismount the knapsack, and to ensure reliable fitting thereof, the stiffening element is a flat one-piece element, provided if necessary with openings, which when it is curved is releasably stretched in the longitudinal and transversal directions only by its upper and lower ends fitting in the upper and lower pockets in the back wall.

29 Claims, 6 Drawing Sheets

FIG. 3
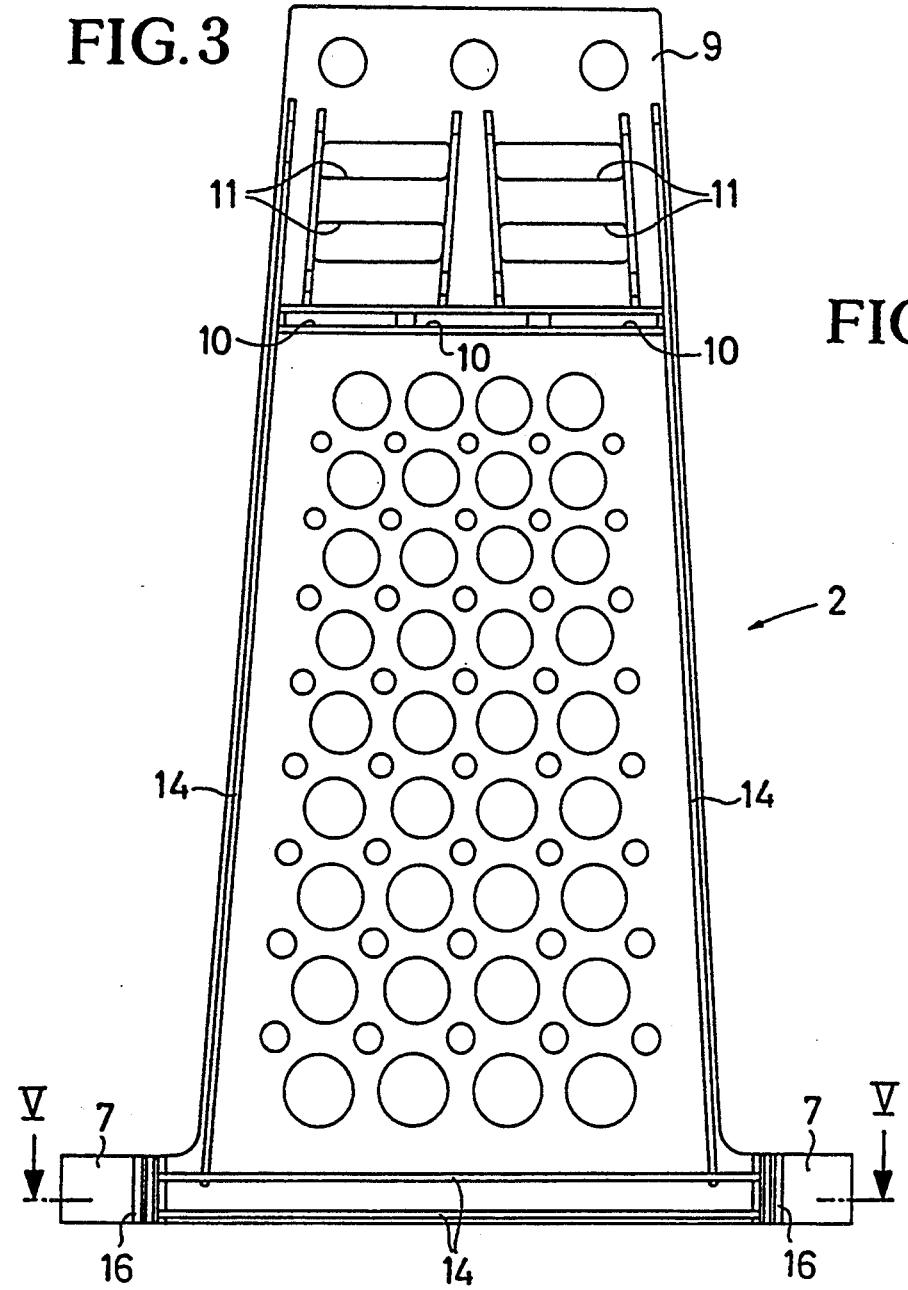
FIG. 4
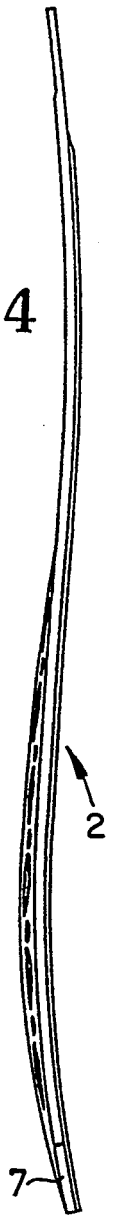
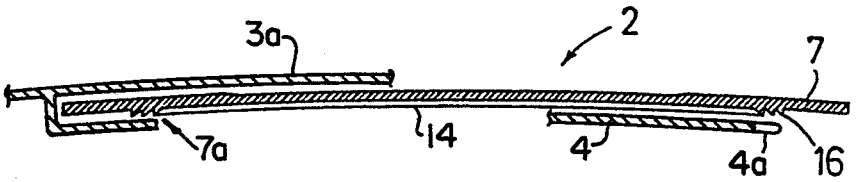
FIG. 5

KNAPSACK WITH REINFORCING ELEMENT

BACKGROUND OF THE INVENTION

The invention relates to a knapsack or back pack with at lest one reinforcing element which is curved concavely, as seen from the outside, at least region-by-region in the longitudinal direction and/or in the transverse direction. Such element is received in pockets provided in a rear wall of the knapsack, and enables the rear wall to be deformed concavely in the longitudinal direction and/or in the transverse direction. A support net is stretched between a bottom region of the reinforcing element, e.g. by an elastic supporting strip extending transversely in the bottom region of the reinforcing element, and an upper region of the reinforcing element.

Such a back pack is known from EP-B-0 158 154 wherein there are disclosed two individual, essentially vertical reinforcing members which merge at the top and whose undersides are connected by another horizontal reinforcing member. The upper ends of the vertical reinforcing members are connected together by an additional horizontal connecting piece which projects sideways beyond the ends of the vertical reinforcing members. An elastic support, over which a support net extends, is arranged above the upper horizontal connecting piece. In this manner air ventilation in the back region is presumably achieved during use of the back pack. From the point of view of production and assembly, however, such arrangement is very expensive. In addition, the framework comprising vertical and horizontal reinforcing members and connecting pieces must be almost completely accommodated in a rear side pocket.

SUMMARY OF THE INVENTION

The object of the present invention is to provide a knapsack or back pack of the aforementioned type in such a manner that, while maintaining air ventilation in the back region of the back pack user, not only are the production, assembly and disassembly of the means provided in essence to maintain such air ventilation in the back region and intended to lower the manufacturing costs simplified, but also carrying the back pack becomes more comfortable.

This object is achieved in accordance with the invention in that a reinforcing element is designed as a one-piece plate-shaped structural member, which may or may not be provided with perforations and whose upper and bottom ends alone are clamped detachably in the longitudinal and transverse directions, while bending, between upper and lower pockets of a rear wall of the knapsack.

Therefore, only a single element that is easy to fabricate is necessary to reinforce the back. Such element can be totally assembled and disassembled with a support net with few manipulations. It is merely necessary that the upper end of the reinforcing element according to the invention be received in a short pocket that is open toward the bottom, because the plate-shaped design ensures that the rear wall, concavely deformed, is held everywhere at an adequate distance from the support net. Owing to the short upper pocket, not only is it possible to save material but also assembly and disassembly of the reinforcing element is facilitated. Perforations can be provided in the reinforcing element, on the one hand to also save material, but on the other hand to facilitate the necessary bending and clamping of the reinforcing element during assembly. In the case of the reinforcing element according to the invention, an upper horizontal connecting piece that protrudes sideways and results in the pocket quickly rubbing through due to its shape is avoided.

The upper end of the reinforcing element can have preferably slotted perforations or depressions, which are arranged side by side and through which straps or loops provided on the upper end of the support net are led in the longitudinal direction for the purpose of stretching the support net. The loops can be fixed by sliding a cross rod through all of the loops after the loops have been slid through the perforations on the rear side of the reinforcing element. The many perforations or depressions arranged side by side provide that the support net rests at the top over a large area of the reinforcing element and does not shift to the side and generate folds.

With the invention the assembly and disassembly of the support net can also be significantly simplified over the state of the art by also receiving the upper end of the reinforcing element in a net pocket of the support net for the purpose of stretching in the longitudinal direction. The clear width of the net pocket is preferably only negligibly larger than the width of the upper end of the reinforcing element, so that the support net is prevented from sliding sideways. In contrast to the aforementioned prior art arrangement, the support net does not have to be led over an elastic support which would be necessary to pad the upper cross connecting piece. In this manner, greater tension can be bestowed on the support net.

In a specific embodiment of the invention, the reinforcing element and/or the support net has/have a width tapering toward the top and is/are designed, for example, in a trapezoidal shape. In this manner, good stability, permanent tension, ease of assembly and good adaptability to the back pack user can be guaranteed. The reinforcing element and/or the support net thus approaches/approach the shape of the back pack that tapers somewhat toward the top.

Within the scope of the invention it also can be provided that the bottom edge of the reinforcing element has projections extending laterally outwardly and received in bottom pockets of the rear wall that are designed as cross pockets that are open in the direction of the vertical center line of the support net. In contrast to the prior art, there is thus no need for a special transverse reinforcing member for the purpose of clamping at the bottom end, but rather merely the side extensions of the single plate-shaped reinforcing element. The projections also do not have to protrude beyond the side edge of the, e.g. trapezoidal, reinforcing element. It is only important that the distance between the outer edges of the two opposing projections be dimensioned in such a manner that the reinforcing element is also clamped in the transverse direction with the aid of the cross pockets, so that a desired concave curvature in the transverse direction of the reinforcing element can also be readily maintained in its bottom region while maintaining a reliable mounting. To absorb tension forces, it is advantageous if the cross pockets are designed on the ends of an upper strap attached over a larger area of the rear wall. The upper strap can extend to the same height as, for example, the supporting strip.

The assembly and disassembly of the support net can be accomplished on its bottom end in a simple manner by stretching the support net itself, or the supporting strip which runs obliquely and is attached at the bottom of the support net and which also serves the purpose of resting on the back of the back pack user, by means of side projections, preferably by means of arresting ribs and eyelets provided in the region of the projections, transversely at the two ends of the supporting strip. Owing to cross stress, the eyelets are held reliably at the arresting ribs, so that the cross stress of the supporting strip is also always guaranteed despite simple assembly and disassembly.

In another embodiment of the invention, the reinforcing element has an extension which protrudes at the top above its concavely curved supporting region and which has preferably slotted perforations in order to guide straps or loops provided on the upper end of the support net, and/or shoulder straps. This design offers itself especially for high back packs, in order to thus guarantee a reinforcement of the back pack region in the shoulder region of the back pack user. The extension simultaneously can be used to clamp the support net and to position the shoulder straps. The plural perforations and straps or loops guarantee a flat contact of the support net. The perforations are staggered at different heights, so that a more or less long support net can be added or the shoulder strap can be guided through the extension at positions more or less spaced from the top, depending on the body size of the back pack user.

Another feature of the invention is that the clear width of the upper pocket at the rear wall is only negligibly greater than the width of the upper end of the reinforcing element. Thus, despite the relatively small depth of the pocket, it is guaranteed that the reinforcing element does not move back and forth sideways when it is carried. At the same time, however, a simple assembly is ensured. It is advantageous if, according to another feature of the invention, the reinforcing element is pre-curved slightly concavely in the longitudinal direction and/or transverse direction in its non-clamped state, and in any event if its contact region is curved concavely in the clamped state. Thus, the reinforcing element can be compressed more easily in the longitudinal or transverse directions, so that a convenient insertion into the rear pockets in order to clamp the reinforcing element is possible. In the clamped state the reinforcing element can then assume a greater curvature than before, so that a reliable clamping of the reinforcing element at the rear wall is guaranteed. In so doing, the upper extension of the reinforcing element can be curved slightly convexly both before and after clamping the reinforcing element. In this region the support net does not have to be held at a distance from the reinforcing element for the purpose of ventilation. In this manner the cross section of the reinforcing element becomes S-shaped, a shape that has a good effect on clamping characteristics.

The reinforcing element according to the invention is made preferably of plastic, on the one hand due to relative ease of fabrication and on the other hand to reduce weight. In the case of a relatively thin plate-shaped material for the reinforcing element, reinforcing ribs extending longitudinally and/or transversely can be provided, preferably in edge regions. In this manner weight is decreased further.

To make carrying of the back pack even more comfortable, the supporting strip on the bottom end of the support net can be provided with a support cushion extension preferably as far as beyond the side projections of the reinforcing element. Thus, the support cushion lies in front of the bottom edge region of the reinforcing element and adapts in the bottom region to the back of the back pack user carrying the back pack.

While the back pack is being used, it can be stabilized by connecting together the shoulder straps by way of a chest strap which is elastic, preferably at least region-by-region, and is provided with an openable closure. Thus, the back pack with the support net is held reliably resting on the back of the back pack user, a feature that is also possible due to existing ventilation. This ease of carrying the back pack can also be supplemented by elongating a cross strap, forming the cross pockets to receive the lateral extensions on the bottom edge of the reinforcing element, into a padded abdominal strap which is provided with an openable closure and which is elastic, preferably at least region-by-region. The cushion provided to this end rests on the hip region of the body of the back pack user, thus in connection with a specific pre-stress of the abdominal strap further stabilizing the back pack at the back of the back pack user.

The back pack according to the invention is adapted to the body size of the back pack user, for example by connecting the shoulder straps, the length of which preferably can be adjusted, by way of additional straps, the length of which can be adjusted, in order to adjust the shoulder region and thus the apex of the shoulder straps above the reinforcing element to the rear wall.

BRIEF DESCRIPTION OF THE DRAWINGS

Other objects, features, advantages, and applications of the present invention will be apparent from the following description with reference to the drawings, all described and/or illustrated features forming by themselves or in any arbitrarily logical combination the subject matter of the present invention, independently of the claims, and wherein:

FIGS. 3 to 5 show a reinforcing element of the invention, according to the embodiment of FIGS. 1 and 2, wherein FIG. 3 is a top view, FIG. 4 is a side view as seen from the left in FIG. 3, and FIG. 5 is a section taken along line V—V of FIG. 3;

FIGS. 8 to 10 show a reinforcing element of the invention, according to the embodiment of FIGS. 6 and 7, wherein FIG. 8 is a top view, FIG. 9 is a side view as seen from the right in FIG. 8, and FIG. 10 is a section taken along line X—X of FIG. 8.

DETAILED DESCRIPTION OF THE INVENTION

Figure 1:
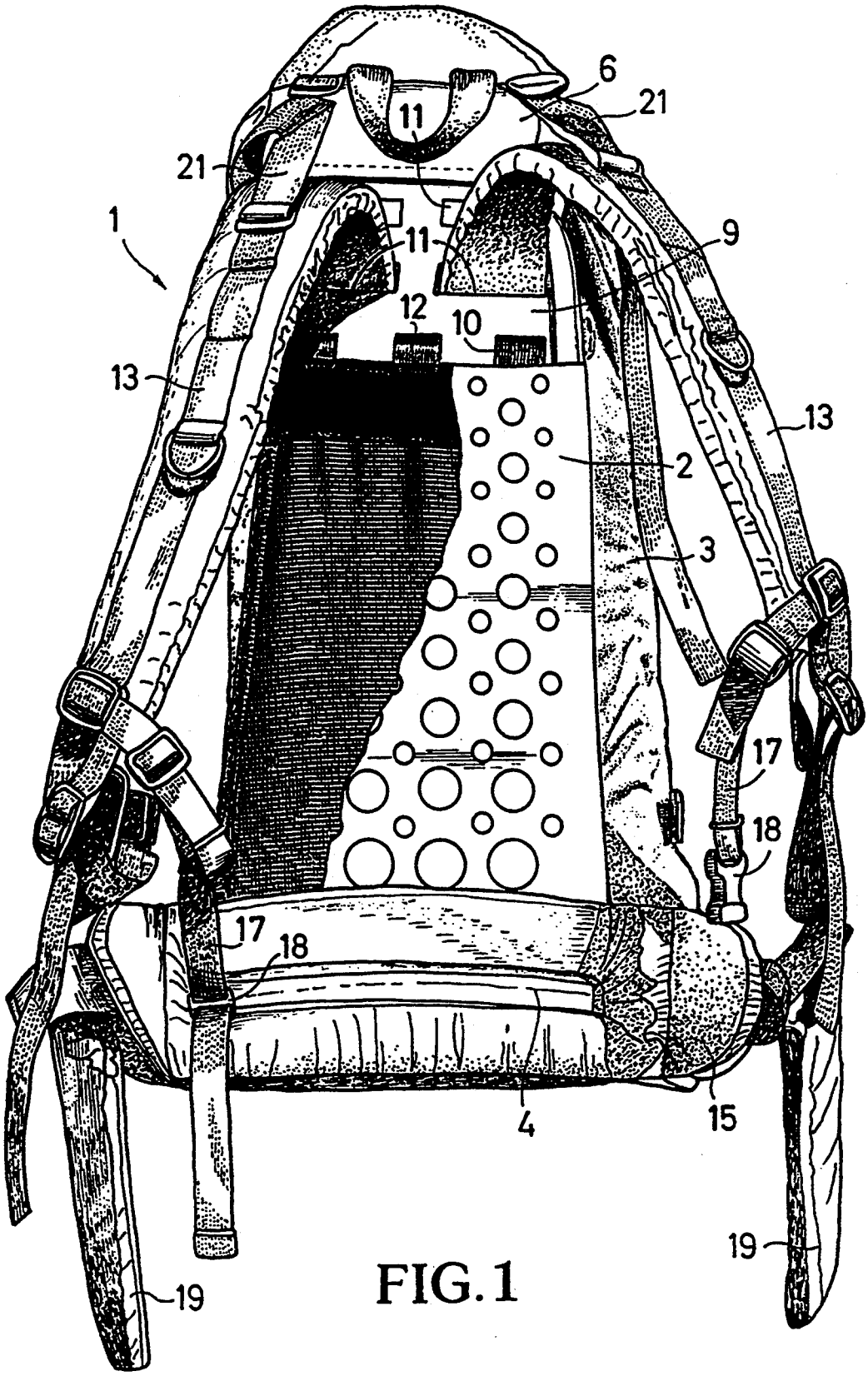
FIG. 1 is a partially broken away side view of a back pack according to a first embodiment of the invention.
Figure 2:
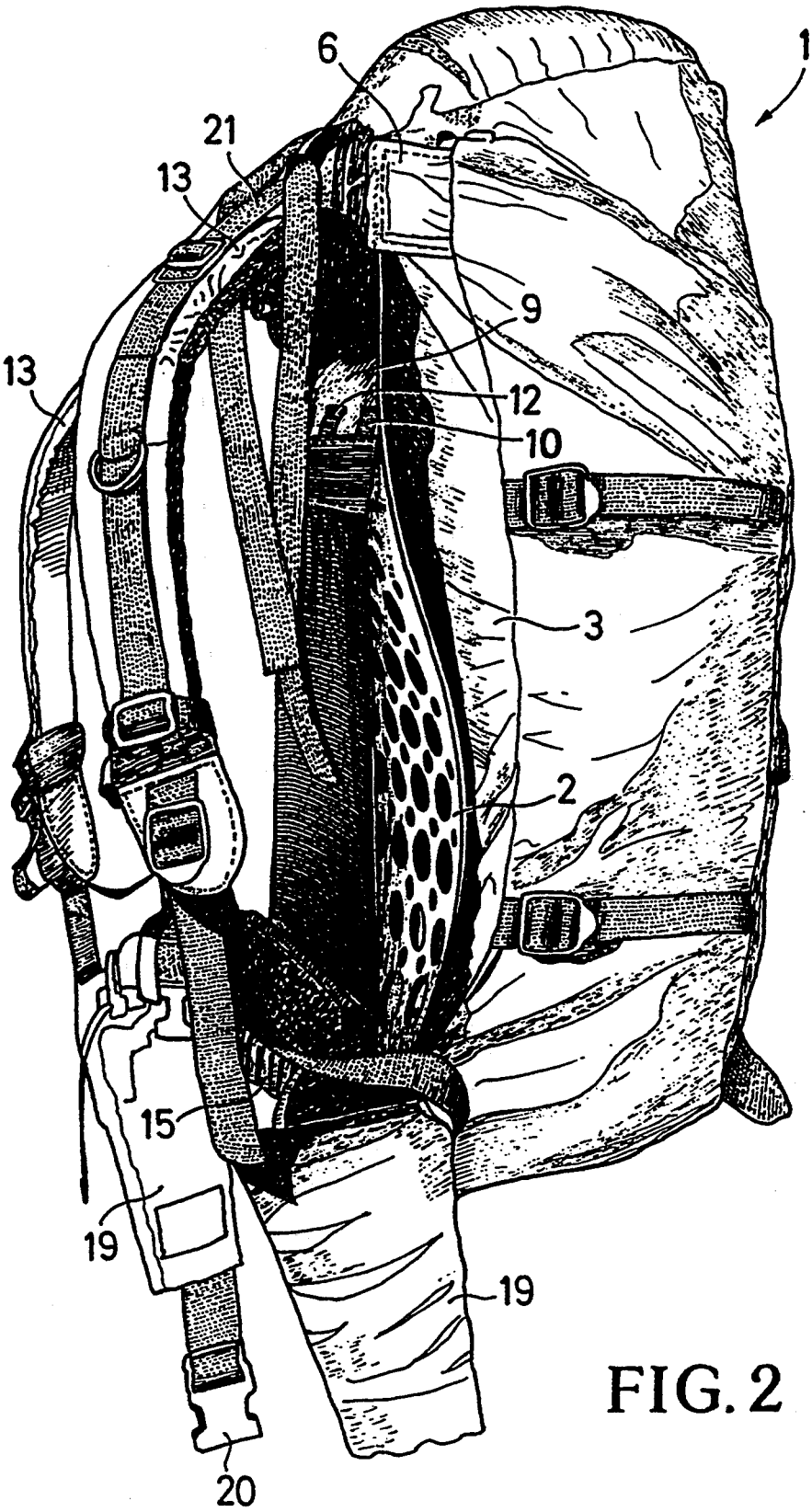
FIG. 2 is a side view of the back pack of FIG. 1, also partially broken away.

A rear wall 3 of a back pack 1, illustrated in FIGS. 1 and 2, is provided with a reinforcing element 2. An upper end only of the reinforcing element 2 is received in a pocket 6 that is open toward the bottom. The bottom end of element 2 has two side projections 7, see FIG. 3, fitting into corresponding side cross pockets 7*a* of the rear wall 3. Such pockets are open centrally in the direction of the vertical center line. In an unclamped starting position the reinforcing element 2 is slightly curved in the longidudinal direction, as is evident from FIGS. 4 and 5, so that the region adjacent the back of the back pack user has, as seen from the outside, a concave curvature. An extension 9, extending upwardly from the top in the shoulder region, has a slight convex curvature. In the cross direction the reinforcing element 2 is also curved slightly concavely, as seen from the outside. Owing to the distance of the upper pocket 6 from the bottom cross pockets for the projections 7, and owing to the distance of the cross pockets from each other, the respective curvatures can be enlarged when the reinforcing element iv assembled to the back pack. The bottom cross pockets have a depth almost corresponding to the length of the projections 7. The upper pocket 6 is dimensioned so small that it covers only a relatively small edge region of the upper end of the reinforcing element 2. Thus, a simple assembly and disassembly of the reinforcing element 2 is possible. Owing to the concave curvature of the reinforcing element 2 in the back region, the rear wall 3 is deformed correspondingly concavely in the longitudinal direction and/or in the transverse direction.

A support net 5 made, for example, of textile material is provided with a bottom elastic support strip 45, which extends transversely, and is stretched by means of eyelets 4*a* at the continuations 7 in front of the reinforcing element 2, the eyelets being retained and stretched apart by means of vertical arresting stops 16 provided at the continuations 7. FIG. 5 shows schematically and at an exaggerated scale and spacing (for clarity of illustration) the arrangement of one continuation 7 (left side) fitting into a pocket 7*a*, and at the opposite side (right side) the intended catching of an eyelet 4*a* on a stop 16 of the other continuation 7. Both sides of the construction have respective such structural arrangements. At the upper end the support net 5 has straps or loops 12 which are guided through slotted perforations 10 in the upper extension 9 of the reinforcing element 2 and are attached in such a manner on the rear side of the reinforcing element 2 that the support net 5 is held under tension. The support net 5 can be fixed into position with the aid of straps or loops 12 in such a manner that, following the insertion through the perforations 10, a cross rod, which holds the support net 5 under the requisite tension in front of the reinforcing element 2, is pushed through all of the loops 12 behind the reinforcing element 2. Owing to the longitudinal and cross tension of the support net 5, a ventilation space is maintained between the reinforcing element and the support net 5 which rests on the back of the back pack user when back pack 1 is being carried.

According to the invention, the reinforcing element 2 is designed as a one-piece plate-shaped component which is provided in the illustrated case, to reduce the amount of material and the weight and to facilitate elasticity in the longitudinal and cross direction, with perforations or holes having, e.g. a circular shape and whose diameters vary. In the extension 9 other slotted perforations 11 for the passage of the shoulder straps 13 are provided, in addition to the perforations 10 for the straps or loops 12. Two pairs of perforations 11 are spaced vertically, as is evident from FIG. 3, so that the shoulder straps 13 can be guided by choice through the bottom or the upper pair of perforations 11, depending on the body size of the back pack user.

As especially evident from FIG. 3, the reinforcing element 2, whose width tapers toward the top in adaptation to the shape of the back pack 1, is designed trapezoidally. The clear width of the upper pocket 6 is only negligibly larger than the width of the upper end of the reinforcing element 2, so that this upper end is held virtually immovably at the rear wall 3. The larger width at the bottom end of the reinforcing element 2 increases the flexibility in the cross direction, so that the projections 7 can be guided easily into the cross pockets by compressing or bending the bottom end of the reinforcing element 2. To be able to absorb the forces exerted on the cross pockets 7*a* by the reinforcing element 2, the cross pockets are made of non-stretchable, tough material on the ends of a cross strap 31, which is attached over a large area to the rear wall 3 and extends under or beneath the supporting strip 4, for example by folding over and sewing tightly the ends of the cross strap. The edge regions of the reinforcing element 2 made, for example, of plastic also have longitudinal and transverse reinforcing ribs 14, as evident especially from FIG. 3.

To further increase the comfort of carrying the back pack 1, the supporting strip 4 is provided with a support cushion 15, as apparent in FIGS. 1 and 2, which reaches as far as over the side projections 7 of the reinforcing element 2. To hold the back pack 1 on the back portion of the back pack user with a reliable abutment of the support net 5, the shoulder straps 13 can be connected together by way of a chest strap 17 which is elastic region-by-region and is provided with an openable closure 18. The length of the two segments of the chest strap 17 can also be adjusted. Furthermore, the cross strap 31 can be elongated into an abdominal strap 19, which also is elastic region-by-region and is provided with an openable closure 20, so that in the region of this part of the body the back pack 1 also can be held on the back of the back pack user with snug abutment of the support net 5. Such snug abutment is possible, because the ventilation space is also maintained between the support net 5 and the concave region of the reinforcing element 2. In this manner, sweating in this area is counteracted despite the firm fitting or seating of the back pack 1 on the back of the back pack user.

In the back pack 1 of FIGS. 1 and 2, the shoulder straps 13 are connected to the rear wall 3 above the reinforcing element 2 by way of longitudinally adjustable additional strips 21. By longitudinal adjustment of the additional straps 21, the shoulder region of the shoulder straps 13 and thus the apex thereof can be changed in adaptation to the body size of the back pack user.

Figure 6:
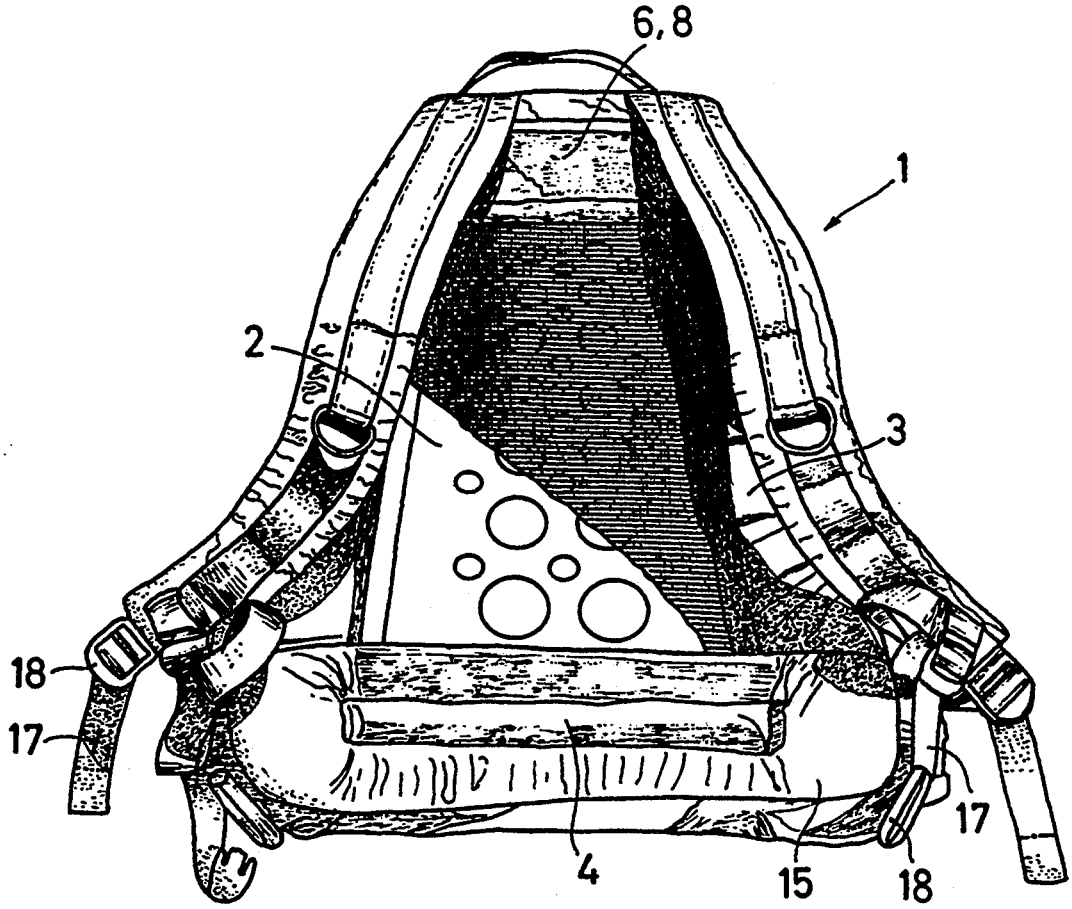
FIG. 6 is a partially broken away view of a back pack according to another embodiment of the invention.
Figure 7:
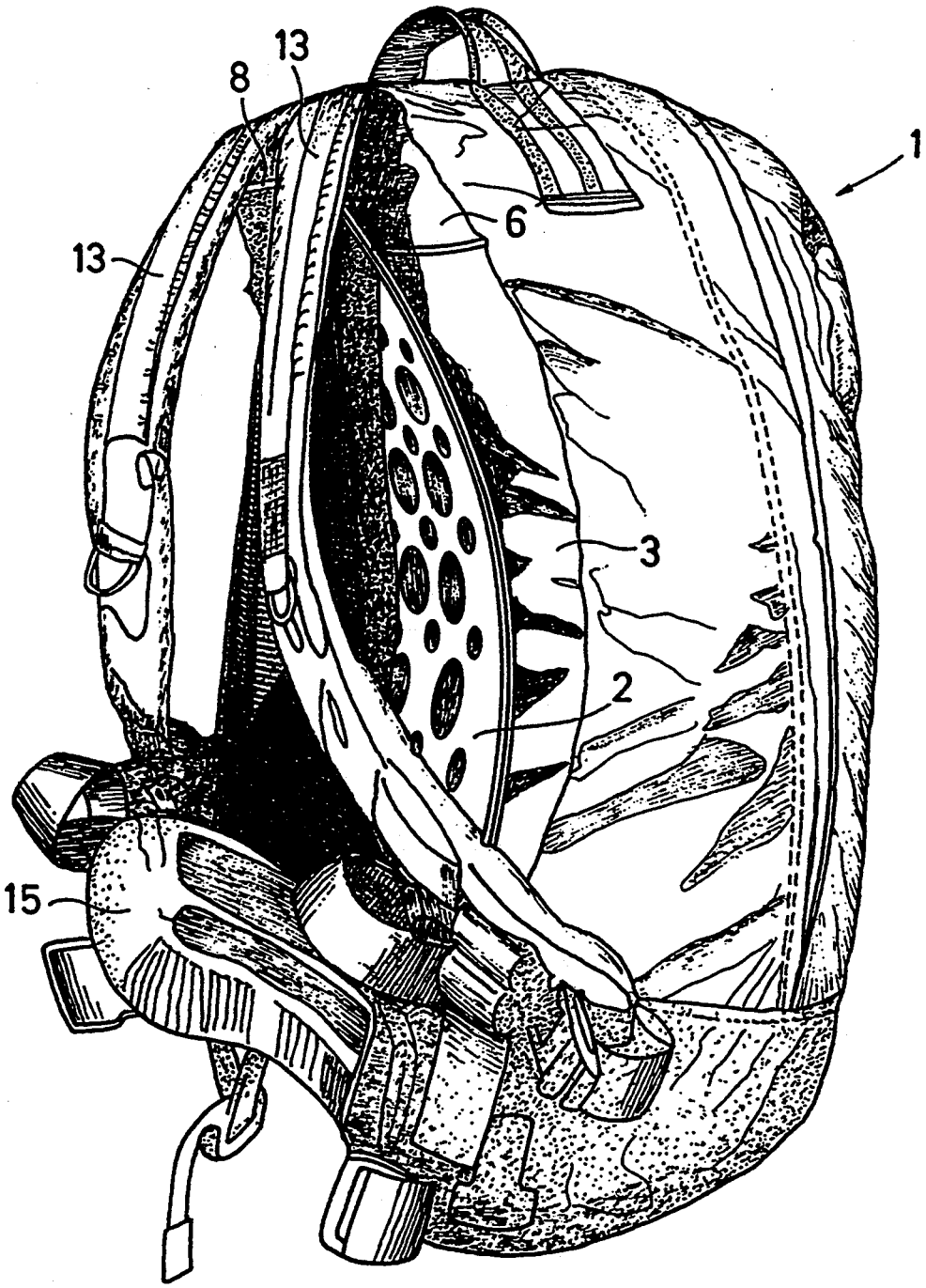
FIG. 7 is a partially broken away side view of the back pack according to FIG. 6.
Figure 8:
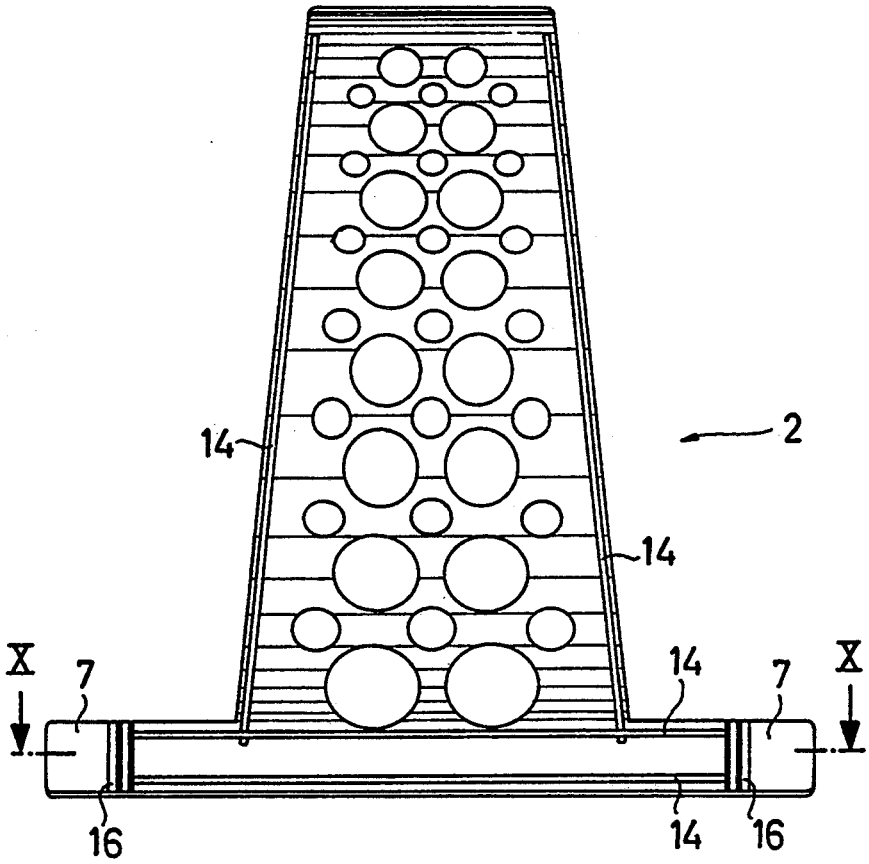
Figure 9:
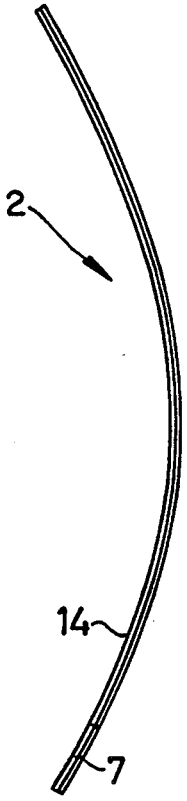
Figure 10:
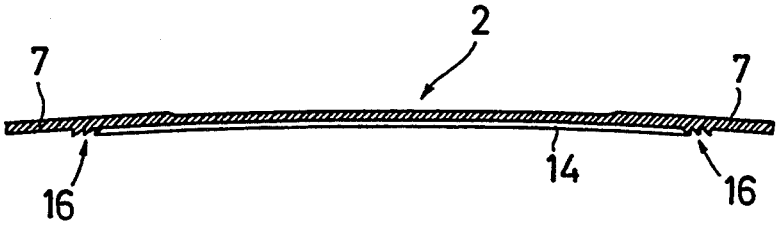

The back pack 1 of the embodiment of FIGS. 6 and 7 includes the reinforcing element 2 shown in FIGS. 8 to 10, differs from the previous embodiment by having a smaller height. Thus, the reinforcing element 2 includes exclusively a region which is concavely curved in the longitudinal direction, in order to suitably deform the rear wall 3. The upper extension 9 of the previous embodiment is not included. To stretch the support net 5, the net has at its upper rend a net pocket 8 which has a shape and size similar to the upper pocket 6 of the rear wall 3. Thus, during assembly the upper end alone of the reinforcing element 2 has to be slid into the net pocket 8 and then both together into the pocket 6, after the bottom end of the reinforcing element 2 with the side continuations 7 has been slid into the corresponding cross pockets for clamping, while the support net 5 is attached to the continuations 7 again by means of eyelets. As is apparent from FIGS. 9 and 10, the reinforcing element can be pre-curved slightly concavely both in the longitudinal and also in the cross directions prior to clamping between the pockets, in order to facilitate assembly and to ensure reliable clamping of the reinforcing element in the pockets.

I claim:

1. A back pack comprising:

a rear wall having upper and lower pockets;

a one-piece, plate-shaped reinforcing element having upper and lower ends and having a curved region curved to define a concave side and a convex side;

said reinforcing element fitted to said rear wall with said convex side of said reinforcing element directed toward said rear wall, thus concavely deforming said rear wall, and with said reinforcing element being retained longitudinally and transversely on said rear wall solely by said upper and lower ends of said reinforcing element being received detachably in said upper and lower pockets, respectively;

a support net stretched over and bridging said concave side of said reinforcing element and having upper and lower ends retained by respective upper and lower portions of said reinforcing element; and said upper and lower pockets being dimensioned to deform said reinforcing element concavely when said upper and lower ends of said reinforcing element are fitted into said upper and lower pockets.

2. A back pack as claimed in claim 1, wherein said reinforcing element is curved longitudinally between said upper and lower ends thereof.

3. A back pack as claimed in claim 2, wherein aid reinforcing element is curved transversely between said upper and lower ends thereof.

4. A back pack as claimed in claim 1, wherein said reinforcing element is curved transversely between said upper and lower ends thereof.

5. A back pack as claimed in claim 1, wherein said reinforcing element has a generally trapezoidal shape with a width narrowing toward said upper end thereof.

6. A back pack as claimed in claim 1, wherein said reinforcing element has therethrough a plurality of perforations.

7. A back pack as claimed in claim 1, wherein said lower end of said net includes an elastic supporting strip extending transversely of said lower portion of said reinforcing element.

8. A back pack as claimed in claim 1, wherein said upper portion of said reinforcing element has therein slots through which extend straps attached to said upper end of said net.

9. A back pack as claimed in claim 1, wherein said upper end of said net includes a net pocket into which fits said upper end of said reinforcing element.

10. A back pack as claimed in claim 9, wherein the width of said net pocket is only slightly greater than the width of said upper end of said reinforcing element.

11. A back pack as claimed in claim 9, wherein said net pocket having therein said upper end of said reinforcing element fits in said upper pocket of said rear wall.

12. A back pack as claimed in claim 1, comprising only a single said upper pocket.

13. A back pack as claimed in claim 1, comprising two said lower pockets opening inwardly with open ends facing each other.

14. A back pack as claimed in claim 13, wherein said lower end of said reinforcing element has projections extending from opposite sides thereof and fitting into respective of said lower pockets.

15. A back pack as claimed in claim 14, wherein said lower pockets are formed in a cross strap extending across said rear wall.

16. A back pack as claimed in claim 14, wherein said lower end of said net is stretched between said projections.

17. A back pack as claimed in claim 16, wherein said lower end of said net has at opposite sides thereof eyelets retained on arresting ribs of respective said projections.

18. A back pack as claimed in claim 1, wherein said reinforcing element includes an extension extending upwardly from said curved region.

19. A back pack as claimed in claim 18, wherein said extension has therethrough slots.

20. A back pack as claimed in claim 19, wherein said upper end of said net has straps fitting through said slots.

21. A back pack as claimed in claim 19, further comprising shoulder straps extending from said rear wall through said slots.

22. A back as claimed in claim 18, wherein said extension is curved oppositely to said curved region.

23. A back pack as claimed in claim 1, wherein said upper pocket has a width only slightly greater than the width of said upper end of said reinforcing element.

24. A back pack as claimed in claim 1, wherein said reinforcing element is made of plastic.

25. A back pack as claimed in claim 1, wherein said reinforcing element includes reinforcing ribs.

26. A back pack as claimed in claim 1, wherein said lower end of said net includes a supporting strip having a support cushion.

27. A back pack as claimed in claim 1, further comprising shoulder straps extending from said rear wall, and an elastic chest strap connecting said shoulder straps and having an openable closure.

28. A back pack as claimed in claim 1, further comprising a cross strap connected to said rear wall and supporting said lower pockets, said cross strap being elongated by an elastic abdominal strap having an openable closure.

29. A back pack as claimed in claim 1, further comprising shoulder straps connected to said rear wall by adjustable additional straps.

* * * * *